US009604099B2

(12) United States Patent
Taylor

(10) Patent No.: US 9,604,099 B2
(45) Date of Patent: Mar. 28, 2017

(54) POSITIONAL LOCK FOR FOOT PEDALS OF AN ELLIPTICAL EXERCISE MACHINE

(71) Applicant: ICON Health & Fitness, Inc., Logan, UT (US)

(72) Inventor: Keith A. Taylor, Plain City, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 6 days.

(21) Appl. No.: 14/582,915

(22) Filed: Dec. 24, 2014

(65) Prior Publication Data

US 2015/0182839 A1 Jul. 2, 2015

Related U.S. Application Data

(60) Provisional application No. 61/922,690, filed on Dec. 31, 2013.

(51) Int. Cl.
*A63B 21/005* (2006.01)
*A63B 21/22* (2006.01)
(Continued)

(52) U.S. Cl.
CPC ..... *A63B 22/0664* (2013.01); *A63B 22/001* (2013.01); *A63B 21/005* (2013.01); *A63B 21/225* (2013.01); *A63B 2022/067* (2013.01); *A63B 2022/0682* (2013.01); *A63B 2071/0072* (2013.01); *A63B 2071/0081* (2013.01); *A63B 2220/20* (2013.01); *A63B 2220/40* (2013.01); *A63B 2220/50* (2013.01);
(Continued)

(58) Field of Classification Search
None
See application file for complete search history.

(56) References Cited

U.S. PATENT DOCUMENTS 5,031,901 A 7/1991 Saarinen
7,004,888 B1 * 2/2006 Weng ..... A63B 21/0051 482/57

(Continued)

FOREIGN PATENT DOCUMENTS

WO 2008138124 11/2008

OTHER PUBLICATIONS

International Search Report issued for PCT/US2014/072385 on Apr. 3, 2015.

(Continued)

*Primary Examiner* — Loan H Thanh
*Assistant Examiner* — Jennifer M Deichl
(74) *Attorney, Agent, or Firm* — Holland & Hart LLP

(57) ABSTRACT

An elliptical exercise machine includes a first foot pedal and a second foot pedal attached to a frame to travel along reciprocating paths. A resistance mechanism is also integrated into the elliptical exercise machine to resist movement of the first and second foot pedals along the reciprocating paths. A locking mechanism is arranged to secure the first and second foot pedals in place and prevent them from moving when the locking mechanism is in a secured mode. The locking mechanism is in communication with a locking input mechanism and is arranged to switch between the secured mode and an operational mode that allows the first and second foot pedals to travel in response to user input received through the locking input mechanism.

17 Claims, 9 Drawing Sheets

(51) Int. Cl.

| | |
|---|---|
| ***A63B 22/00*** | (2006.01) |
| ***A63B 22/06*** | (2006.01) |
| ***A63B 71/00*** | (2006.01) |

(52) U.S. Cl.
CPC ..... *A63B 2220/806* (2013.01); *A63B 2225/50* (2013.01); *A63B 2230/01* (2013.01); *A63B 2230/015* (2013.01)

(56) References Cited

U.S. PATENT DOCUMENTS

| | | | | |
|---|---|---|---|---|
| 7,547,267 | B1 | 6/2009 | Wang | |
| 8,025,610 | B2 * | 9/2011 | Chang | A63B 22/001 482/52 |
| 2008/0051274 | A1 * | 2/2008 | Greene | A63B 22/0002 482/142 |
| 2008/0280735 | A1 | 11/2008 | Dickie et al. | |
| 2010/0255959 | A1 | 10/2010 | Dalebout et al. | |
| 2014/0024499 | A1 * | 1/2014 | Watterson | A63B 22/04 482/52 |

OTHER PUBLICATIONS

Website: http://www.treadmilladviser.com/smooth-agile-dmt-x2.html (Sep. 29, 2013).

* cited by examiner

POSITIONAL LOCK FOR FOOT PEDALS OF AN ELLIPTICAL EXERCISE MACHINE

RELATED APPLICATIONS

This application claims priority to provisional Patent Application No. 61/922,690 titled "Positional Lock for Foot Pedals of an Elliptical Exercise Machine" filed Dec. 31, 2013. This application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling among other types of aerobic exercise. In contrast, anaerobic exercise often involves high intensity exercises over a short duration of time. Popular forms of aerobic exercise include strength training and short distance running.

Many choose to perform aerobic exercises indoors, such as in a gym or their home. Often, a user will use an aerobic exercise machine to have an aerobic workout indoors. One such type of aerobic exercise machine is an elliptical, which often includes foot supports that move in reciprocating directions when moved by the feet of a user. Often, the foot supports will be mechanically linked to arm levers that can be held by the user during the workout. The arm levers and foot supports move together and collectively provide resistance against the user's motion during the user's workout. Other popular exercise machines that allow a user to perform aerobic exercises indoors include treadmills, rowing machines, stepper machines, and stationary bikes to name a few.

One type of elliptical exercise machine is disclosed in U.S. Pat. No. 8,025,610 issued to Yao-jen Chang. In this reference, a safety device for use with an elliptical exercise machine includes a holder frame, a movable member, a locking member, and an operating member. The holder frame is fixedly mounted in the elliptical exercise machine at a predetermined selected location. The movable member is movably mounted in the elliptical exercise machine. The locking member is movably mounted in the holder frame in order to selectively lock the movable member from moving. The operating member is operable to move the locking member. A user can lock the movable member of the elliptical exercise machine after each exercise. When the user uses the elliptical exercise machine again and steps on the pedals of the elliptical exercise machine before starting to exercise, the user will not accidentally fall from the elliptical exercise machine due to an unexpected displacement of the center of gravity. Other types of elliptical exercise machines are described in U.S. Pat. No. 5,031,901 issued to Sulevi Saarinen and WIPO Patent Publication No. WO/2008/138124 to Robert Dickie. Each of these references is herein incorporated by reference for all that they contain.

SUMMARY

In one aspect of the invention, an elliptical exercise machine includes a frame.

In one aspect of the invention, the elliptical exercise machine includes a first foot pedal and a second foot pedal movably attached to the frame to travel along reciprocating paths.

In one aspect of the invention, the elliptical exercise machine may further include a resistance mechanism integrated into the elliptical exercise machine to resist movement of the first foot pedal and the second foot pedal along the reciprocating paths.

In one aspect of the invention, the elliptical exercise machine may further include a locking or securing mechanism arranged to secure the first foot pedal and the second foot pedal in place and prevent them from moving when the locking or securing mechanism is in a secured mode.

In one aspect of the invention, the locking or securing mechanism is located proximate a console of the elliptical exercise machine.

In one aspect of the invention, the locking or securing mechanism is arranged to switch between the secured mode and an operational mode where the first foot pedal and the second foot pedal are released to travel in response to user input received through the locking input mechanism.

In one aspect of the invention, the first foot pedal is mechanically linked to a first arm support and the second foot pedal is mechanically linked to a second arm support wherein the first arm support and the second arm support move in a reciprocating motion as the first foot pedal and the second foot pedal travel along the reciprocating paths.

In one aspect of the invention, the locking or securing mechanism is integrated into the resistance mechanism such that in response to the user input to be in a secured mode, the resistance mechanism exerts a resistance sufficient to secure the first foot pedal and the second foot pedal in position.

In one aspect of the invention, the resistance mechanism is in communication with a resistance input mechanism that is in communication with the resistance mechanism to apply an amount of resistance to the travel of the first foot pedal and the second foot pedal.

In one aspect of the invention, the resistance input mechanism is independent of the locking input mechanism.

In one aspect of the invention, the locking or securing mechanism is arranged to exert a magnetic resistance sufficient to secure the first foot pedal and the second foot pedal in position.

In one aspect of the invention, the locking or securing mechanism includes a feature that is arranged to move into and interlock with a mechanical linkage that mechanically connects the first foot pedal and the second foot pedal.

In one aspect of the invention, the locking or securing mechanism includes a feature that is arranged to move into and interlock with a flywheel.

In one aspect of the invention, the elliptical exercise machine a default mode of the locking or securing mechanism is the secured mode.

In one aspect of the invention, may further include that the locking input mechanism is a button.

In one aspect of the invention, the locking mechanism includes a storage memory medium and a processor wherein the storage memory medium comprises programmed instructions that, when executed by the processor, control when the locking mechanism is in the secured mode or in the operational mode.

In one aspect of the invention, the programmed instructions, when executed by the processor, cause the locking mechanism to switch to the secured mode in response to a predetermined period of non-use.

In one aspect of the invention, the elliptical exercise machine comprises a second locking mechanism that provides a secondary lock arranged to prevent the first foot pedal and the second foot pedals from traveling.

In one aspect of the invention, the locking input mechanism located proximate the console is located near the console, on the console, in an arm guard, on handgrips, on an upper portion of the frame of the elliptical exercise machine, or combinations thereof.

In one aspect of the invention, the elliptical exercise machine may include a frame.

In one aspect of the invention, the elliptical exercise machine may further include a first foot pedal and a second foot pedal movably attached to the frame to travel along reciprocating paths.

In one aspect of the invention, the elliptical exercise machine may further include a resistance mechanism integrated into the elliptical exercise machine to resist movement of the first foot pedal and the second foot pedal along the reciprocating paths.

In one aspect of the invention, the elliptical exercise machine may further include a locking mechanism arranged to prevent the first foot pedal and the second foot pedal from moving when the locking mechanism is in a secured mode.

In one aspect of the invention, the locking mechanism is in communication with a locking input mechanism that is integrated into the elliptical exercise machine located at a remote location from the resistance mechanism.

In one aspect of the invention, the locking mechanism include a storage memory medium and a processor wherein the storage memory medium comprises programmed instructions that, when executed by the processor, switch the locking mechanism between the secured mode and an operational mode where the first foot pedal and the second foot pedal are released to travel in response to user input received through the locking input mechanism.

In one aspect of the invention, the locking mechanism is integrated into the resistance mechanism such that in response to the user input to be in a secured mode, the resistance mechanism exerts a resistance sufficient to secure the first foot pedal and the second foot pedals in position.

In one aspect of the invention, the resistance mechanism is in communication with a resistance input mechanism in communication with the resistance mechanism to apply an amount of resistance to the travel of the first foot pedal and the second foot pedal where the resistance input mechanism is independent of the locking input mechanism.

In one aspect of the invention, the elliptical exercise machine may further include programmed instructions that cause the locking mechanism to switch to a secured mode in response to a predetermined period of non-use.

In one aspect of the invention, the elliptical exercise machine may include a frame.

In one aspect of the invention, the elliptical exercise machine may further include a first foot pedal and a second foot pedal movably attached to the frame to travel along reciprocating paths.

In one aspect of the invention, the elliptical exercise machine may further include a resistance mechanism integrated into the elliptical exercise machine to resist movement of the first foot pedal and the second foot pedal along the reciprocating paths.

In one aspect of the invention, the elliptical exercise machine may further include a locking mechanism arranged to prevent the first foot pedal and the second foot pedal from moving when the locking mechanism is in a secured mode.

In one aspect of the invention, the locking mechanism is in communication with a locking input mechanism that is integrated into the elliptical exercise machine and located in a control module to control mechanisms of the elliptical exercise machine.

In one aspect of the invention, the locking mechanism includes a storage memory medium and a processor wherein the storage memory medium comprises programmed instructions that, when executed by the processor, are arranged to switch the locking mechanism between the secured mode and an operational mode where the first foot pedals and the second foot pedal are released to travel in response to user input received through the locking input mechanism.

In one aspect of the invention, the programmed instructions are further cause the locking mechanism to switch to a secured mode in response to a predetermined period of non-use.

In one aspect of the invention, the locking mechanism is integrated into the resistance mechanism such that in response to the user input to be in a secured mode, the resistance mechanism exerts a resistance sufficient to secure the first foot pedal and the second foot pedal in position.

Any of the aspects of the invention detailed above may be combined with any other aspect of the invention detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

Figure 1:
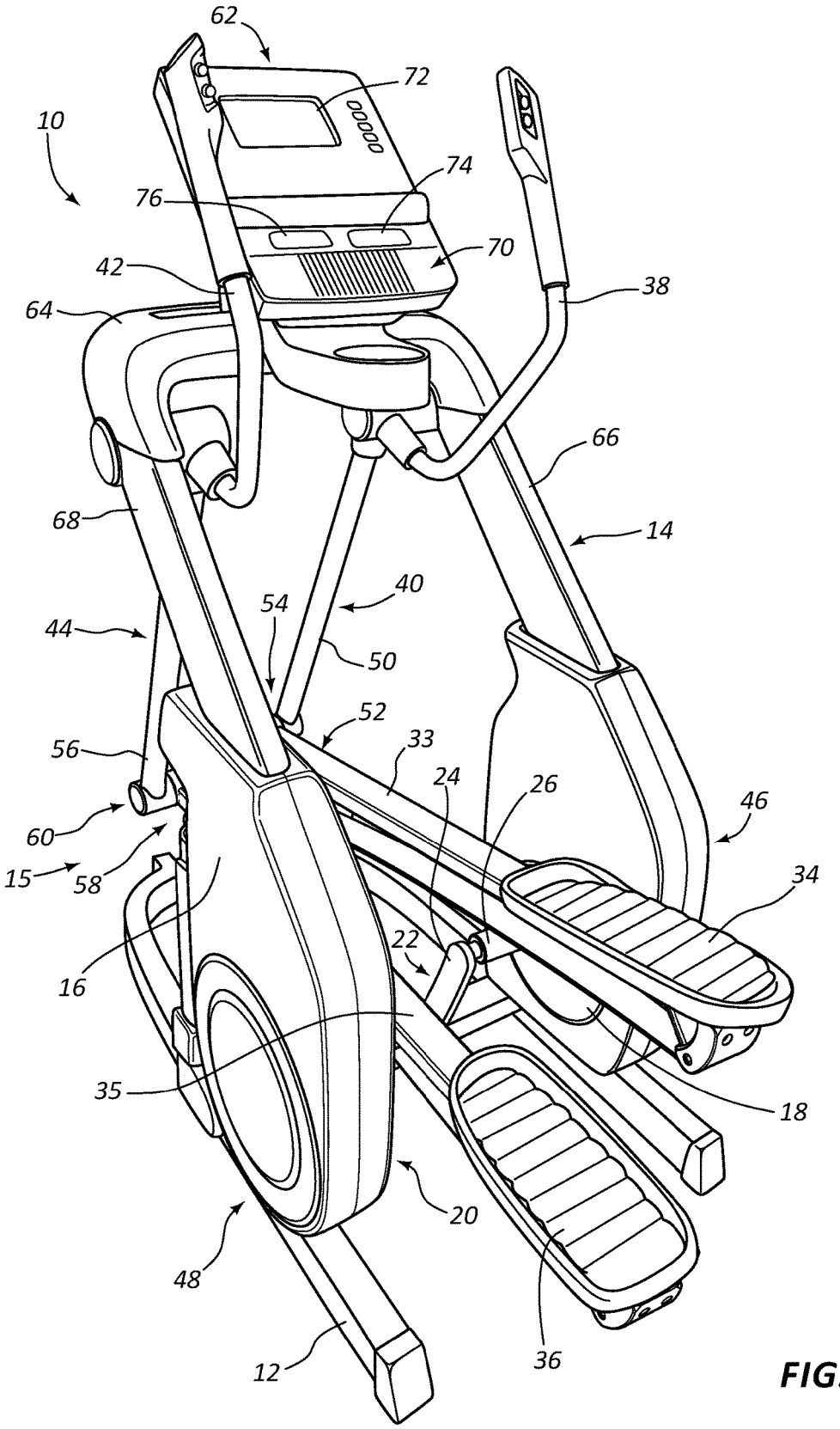
FIG. 1 illustrates a perspective view of an example of an exercise machine in accordance with the present disclosure.

An elliptical exercise machine may include foot pedals that are mechanically linked together. Such foot pedals are often mechanically linked to arm supports that move with the foot pedals of the elliptical. Thus, when any of either the foot pedals or either of the arm supports move, each of the foot pedals and each of the arm supports will move. As a result, when a user moves any of these components, each of the components will move together. For example, a user may place a foot on one of the pedals to move the other foot pedal and the arm supports. When the user puts his entire weight on the foot pedal, which generally occurs when a user is getting on or off of the elliptical machine, the user's weight will be loaded to the single foot pedal. As a result, the loaded foot pedal will move about a crank arm to a lowest azimuthal position about a rotational axis of the crank assembly. Consequently, the other foot pedal will move to the highest azimuthal position about the rotational axis of the crank assembly when the foot pedals are connected together through the crank assembly. Likewise, the arm supports will also move based on the movement of the foot pedals. A user often gets on or off of the elliptical by first placing all of his or her weight onto a single foot pedal. As a result, the position of the foot pedals and arm supports will change as described above.

The principles described in the present disclosure lock the foot pedals in place so that the foot pedals do not move as the user mounts or dismounts the elliptical. By keeping the position of the foot pedals fixed in place during the mounting and dismounting of the elliptical machine, the user has additional stability when mounting and dismounting the elliptical exercise machine. The locking mechanism is located within a convenient arm's reach for the user without the user having to bend down to secure or release the foot pedals. For example, a button, a lever, a touch pad, or another user input mechanism to control the locking mechanism can be incorporated into a control module of the elliptical machine that the user can reach while standing in an upright position on the elliptical machine.

For example, if the locking mechanism includes a pin that moves into or out of a receptacle formed in a flywheel of the elliptical, the user does not have to bend down to reach the pin at the flywheel after the user is standing of the foot pedals ready to exercise when the user controls the locking mechanism through the user input mechanism. Likewise, the user will not have to reach down to the flywheel to move the pin into a position to secure the flywheel in place before dismounting when the user controls the locking mechanism through the user input mechanism. The principles described herein enable the user to secure or release the position of the foot pedals while the user is standing on the foot pedals in an upright position because the user can control the locking mechanism at a location that is remote from the resistance mechanism of the elliptical but may be within a convenient reach of the user's arms while the user stands on the foot pedals. Thus, the user can first step onto the elliptical and send a command to unlock the position of the foot pedals before beginning to exercise without having the reach down to manually unlock the flywheel. Further, the user can also stop exercising and send a command to secure the position of the foot pedals before the user dismounts through the user input mechanism. The user has the ability to send such commands in a stable upright position and does not have to rely on another person to secure or release the foot pedals.

For the purposes of the present disclosure, the phrase "located at a remote location from the resistance mechanism" refers to a location of any appropriate component or assembly that is either not in the vicinity of the resistance mechanism or a component that does not directly make physical contact the components of the resistance mechanism. Such a component may make indirect contact with the resistance mechanism by making physical contact with part of mechanical linkage that moves with the resistance mechanism. An example of a remote location includes a location on a control module, an arm support, a cross bar, or another feature that is within a convenient arm's reach of a user that is standing in an upright position on the elliptical's foot pedals when the resistance mechanism is located on a flywheel that is positioned near or under the user's knees. Further examples of the remote location include sensors that are incorporated into the control module, the foot pedals, the tracks, other parts of the mechanical linkage, other parts of the elliptical exercise machine, or combinations thereof. Such sensors may include cameras, load cells, accelerometers, distance sensors, other types of sensors, or combinations thereof. Such sensors may be used to determine a condition of the elliptical exercise machine and/or the user. For example, the sensors may determine whether the user is getting on or off the elliptical exercise machine, whether the user's weight is appropriately distributed across both foot pedals, whether the user is adjusting weight between the foot pedals, whether there has been a predetermined period of inactivity, other conditions, or combinations thereof. In some examples, the remote location is spaced more than one foot (0.3 meters) away from the resistance mechanism.

For purposes of the present disclosure, the term "resistance mechanism" includes those components that directly and selectively interact to cause an added degree of resistance during the user's workout. For example, a resistance mechanism may include a flywheel when the elliptical exercise machine has components that can adjustably impose resistance to the movement of the flywheel, such as imposing a magnetic force on the flywheel to restrict the flywheel's rotation. The flywheel is included in the resistance mechanism when other components interact with the flywheel to directly resist the flywheel's movement. For example, braking pads, tensioning elements, fan blades, or other components can be used to directly to resist the movement of the flywheel. In such examples, both the flywheel and the components interacting to adjustably resist the movement of the flywheel are included as part of the resistance mechanism.

Figure 2:
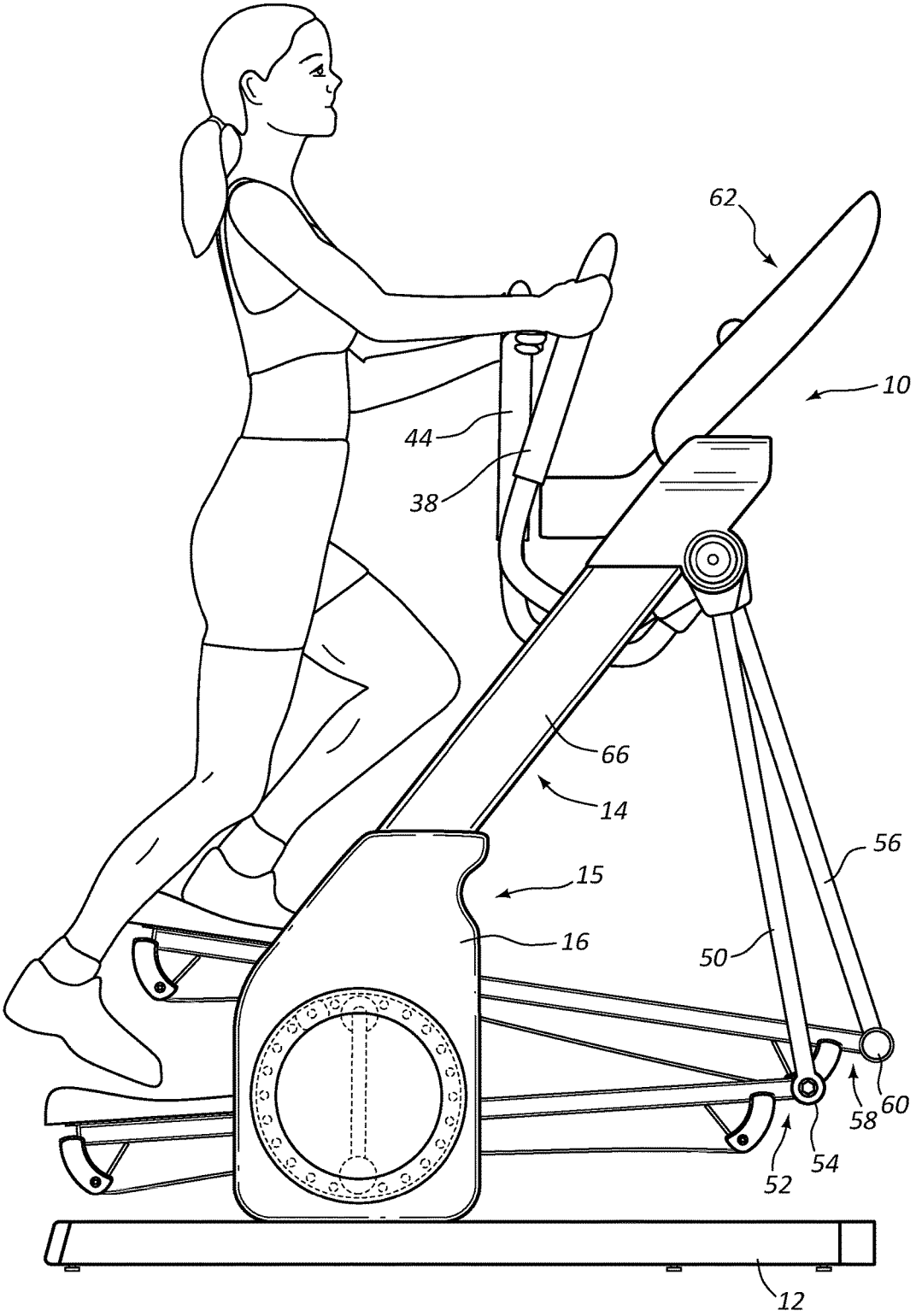
FIG. 2 illustrates a side view of the exercise machine of FIG. 1.

Particularly, with reference to the figures, FIGS. 1-2 depict an example of an elliptical exercise machine 10, such as an elliptical machine. The elliptical exercise machine 10 includes a base 12 that is attached to a support frame 14 at a first connection 46 and a second connection 48. A lower portion 15 of the support frame 14 includes a housing 16 that supports a first flywheel 18 and a second flywheel 20. The first flywheel 18 and the second flywheel 20 are attached to one another through a crank assembly 22. The crank assembly 22 includes a crank arm 24 that is attached to a first roller shaft 26 that is connected to the first flywheel 18 on a first end and attached to a second roller shaft 30 that is connected to the second flywheel 20 at a second end.

The first shaft 26 is attached to an underside of a first track 33 that supports a first foot pedal 34, and the second shaft 30 is attached to an underside of a second track 35 that supports a second foot pedal 36. The crank assembly 22 is shaped such that the first shaft 26 and the second shaft 30 follow reciprocating paths. Consequently, the first foot pedal 34 follows the path of the first shaft 26, and the second foot pedal 36 follows the path of the second shaft 30. As a user stands on the first foot pedal 34 and the second foot pedal 36 for a workout, the user's feet will also follow the reciprocating paths of the first foot pedal 34 and the second foot pedal 36 respectively. In some examples, the first foot pedal 34 is slideably arranged along the length of the first track 33. Likewise, the second foot pedal 36 is slideably arranged along the length of the second track 35. Thus, in some examples, the first foot pedal 34 and the second foot pedal 36 are movable in multiple directions. For example, the foot pedals 34, 36 may move down the length of the tracks and/or with the reciprocating paths traveled by the first shaft 26 and the second shaft 30. In some examples, a stopping mechanism is incorporated into the elliptical exercise machine 10 to stop the first foot pedal 34 and the second foot pedal 36 from sliding along the lengths of the first track 33 and the second track 35 respectively.

The first foot pedal 34 is connected to a first arm support 38 through a first mechanical linkage 40, and the second foot pedal 36 is connected to a second arm support 42 through a second mechanical linkage 44. The first arm support 38 is connected to the support frame 14 at a first pivot connection, and the second arm support 42 is connected to the support frame 14 at a second pivot connection. In the example of FIGS. 1-2, the first mechanical linkage 40 includes a first bottom section 50 of the first arm support 38 being connected to a first far end 52 of the first track 33 at a first joint 54. Likewise, the second mechanical linkage 44 includes a second bottom section 56 of the second arm support 42 being connected to a second far end 58 of the second track 35 at a second joint 60.

A control module 62 is connected to a cross bar 64 that connects a first post 66 of the support frame 14 to a second post 68 of the support frame 14. The control module 62 may include multiple buttons 70, a display 72, a cooling vent, a speaker, another device, or combinations thereof. The control module 62 may also include a locking input mechanism 74 that allows the user to control a locking mechanism 75 that locks the first foot pedal 34 and the second foot pedal 36 in position. Also, the control module 62 can include a resistance input mechanism 76 that allows the user to control how much resistance is applied to the movement of the first foot pedal 34, the second foot pedal 36, the first arm support 38, and the second arm support 42. The control module 62 may also provide the user with an ability to control other mechanisms of the elliptical exercise machine 10. For example, the control module 62 may be used to control a level of a climate control, to control an incline of the first track 33 and the second track 35, to control speaker volume, to select a preprogrammed workout, to control entertainment through the speakers of the display 72 of the control module 62, to monitor a health parameter of the user during a workout, to communicate with a remote trainer or computer, to control other mechanisms, or combinations thereof.

While this example has been described with reference to a locking input mechanism 74 located on the console, the locking input mechanism 74 may be located at any appropriate location in accordance with the principles described herein. For example, the locking input mechanism 74 may be located proximate the console, near the console, on the console, in an arm guard, on handgrips, on an upper portion of a frame of the elliptical exercise machine, or combinations thereof.

The locking mechanism 75 may be located at any location that can lock the movement of the first foot pedal 34 and the second foot pedal 36. For example, the locking mechanism 75 can be located adjacent to the first flywheel 18 and/or the second flywheel 20. The locking mechanism 75 may include a member that is arranged to move towards and interlock with the flywheels or otherwise prevent the flywheels from rotating. Such a member may include a pin, a screw, a compression member, a hook, a clamp, another type of member, or combinations thereof. In other examples, the locking mechanism 75 may include a magnetic resistance device that can impose a magnetic resistance strong enough to prevent the movement of the flywheels even when an entire weight of a user is loaded to either the first foot pedal 34 or the second foot pedal 36. Such a magnetic resistance device may also be used to provide magnetic resistance to the flywheels during a workout, but with a greater intensity when commanded to a lock the flywheel in place than when merely applying a resistance force for a workout. For example, a workout resistance level will still allow the flywheels to move. However, a locking resistance level is sufficient to prevent any movement of the flywheels. As a result, the flywheels will remain in their locked positions despite an entire weight of a user being loaded to either the first foot pedal 34 or the second foot pedal 36. In such an example, the magnetic resistance device may automatically apply a maximum level of resistance when the locking input mechanism 74 indicates that the user wants the foot pedals in a secured mode.

The locking mechanism 75 may also be adjacent to other locations on the elliptical exercise machine 10. For example, the locking mechanism 75 may be positioned adjacent to and arranged to stop the movement of the components of the crank assembly 22, the first track 33, the second track 35, another component of the elliptical exercise machine 10, or combinations thereof.

In some examples, the locking mechanism 75 is activated to secure the position of the foot pedals into place as a default mode. In such an example, the elliptical exercise machine 10 may be automatically set to a secured mode after a predetermined period of non-use.

In other examples, the elliptical exercise machine 10 may incorporate a threshold activation mechanism that senses when a user is about to mount the elliptical exercise machine 10. In such an example, the elliptical exercise machine 10 may sense when a predetermined weight or load is exceeded on the foot pedals. As a result of the predetermined weight or load being exceeded, the locking mechanism 75 automatically locks the position of the foot pedals in place. In such an example, the foot pedals may travel just a little distance along the reciprocating paths before being stopped. Such a threshold activation mechanism may conserve power when the locking mechanism 75 incorporates a magnetic resistance device because the magnetic resistance is applied just at the moments when user is actually mounting the elliptical exercise machine 10. In such an example, the user may send a command through the control module 62 to release the foot pedals.

The locking mechanism 75 may be programmed to operate based on user input to secure and user input to release the foot pedals. In such examples, the user tells the locking mechanism 75 when to release and when to secure. In alternative examples, the locking mechanism 75 may activate for just a predetermined period of time that is long enough for the user to get onto or off of the elliptical exercise machine 10. For example, the locking mechanism 75 may lock the foot pedals in place in response to determining that the user is getting onto the elliptical exercise machine 10. The locking mechanism 75 may lock for a predetermined length of time between five seconds to sixty seconds before automatically releasing the foot pedals. In this manner, the user does not have to command the foot pedals to release. The user may have an option to select the predetermined time period.

In another example, the elliptical exercise machine 10 can determine when the user is ready for a workout before releasing the foot pedals. In such an example, the elliptical exercise machine 10 may include an accelerometer that senses when the user is moving onto or off the elliptical exercise machine 10. When the accelerometer determines that the user has stopped moving, the locking mechanism 75 may release the foot pedals. In another example, load sensors incorporated into the foot pedals may determine when the user's weight is distributed across both foot pedals or when the weight of the user stabilizes between the foot pedals. In yet another example, a camera or distance sensor may be used to determine when the user's feet are on both of the foot pedals.

While this example has been described with reference to specifically using an automatic release based on a predetermined period of time with an automatic detection activation mechanism, such an automatic release mechanism may be used with manually controlled activation mechanisms. Likewise, automatic activation mechanisms may be used with automatic release mechanisms.

The elliptical exercise machine 10 may include a locking mechanism status indicator to let the user know whether the elliptical exercise machine 10 is in the secured mode or the operational mode. Such an indicator may include a message on the display 72, an light emitting diode incorporated in the control module 62, the presence of a predetermined icon in the display 72, another type of mechanism, or combinations thereof.

Figure 3A:
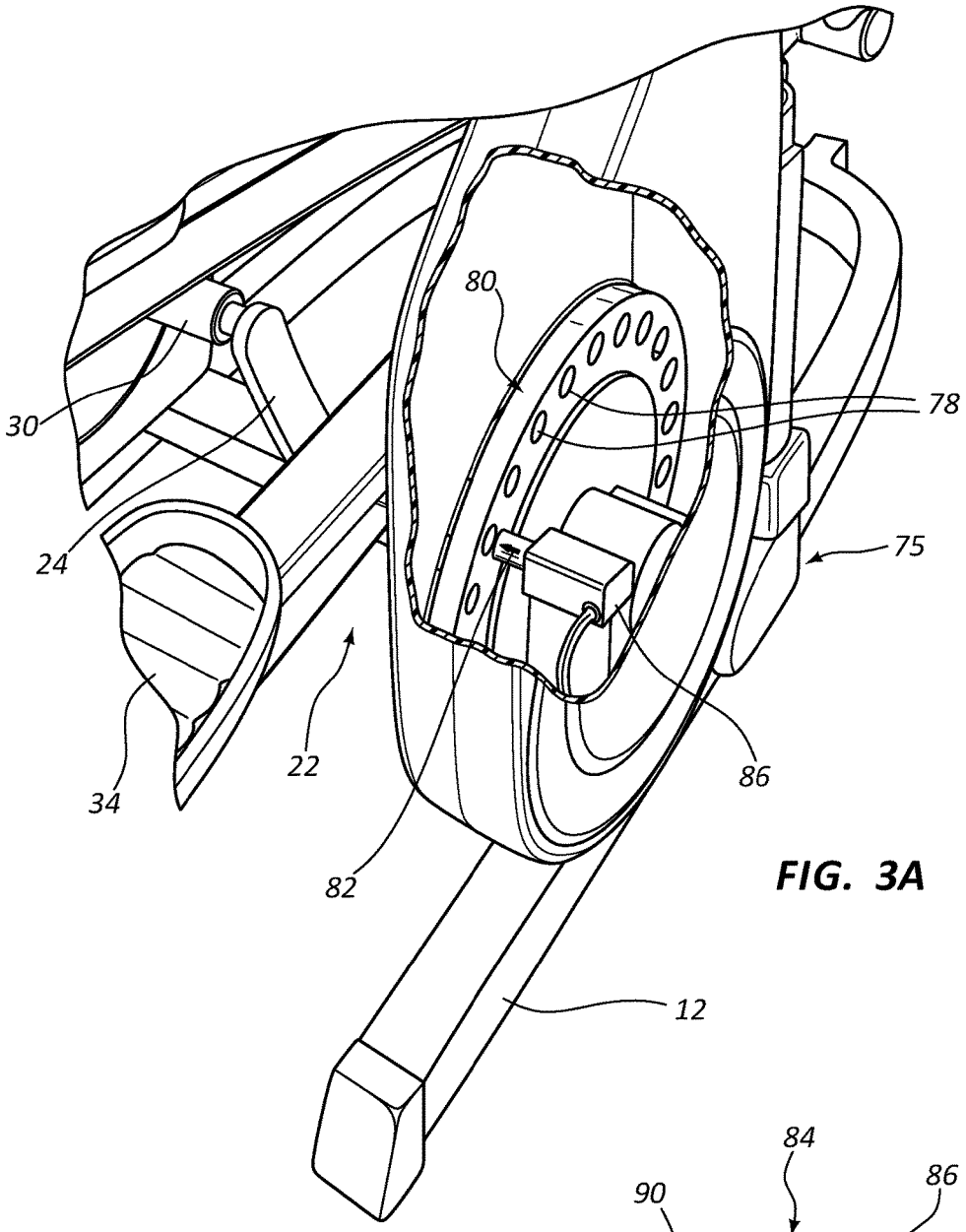
FIG. 3*a* illustrates a perspective view of an example of a locking mechanism in accordance with the present disclosure.

FIG. 3*a* illustrates a perspective view of an example of a locking mechanism 75 in accordance with the present disclosure. In this example, the first flywheel 18 is positioned under the first foot pedal 34. The first foot pedal 34 is connected to the first shaft 26 of the crank assembly 22.

Multiple holes 78 are formed near the periphery 80 of the first flywheel 18. These holes 78 are spaced equidistantly from one another and are spaced so that a pin 82 of the locking mechanism 75 can protrude into the voids formed by the holes 78. Each of the holes 78 represents an azimuthal position in which the foot pedals can occupy when the elliptical exercise machine 10 is in a secured mode. Such a pin 82 may be moved into one of the holes 78 in response to a command from a remote location, such as the control module 62 or from either of the first arm support 38 or the second arm support 42.

Figure 3B:
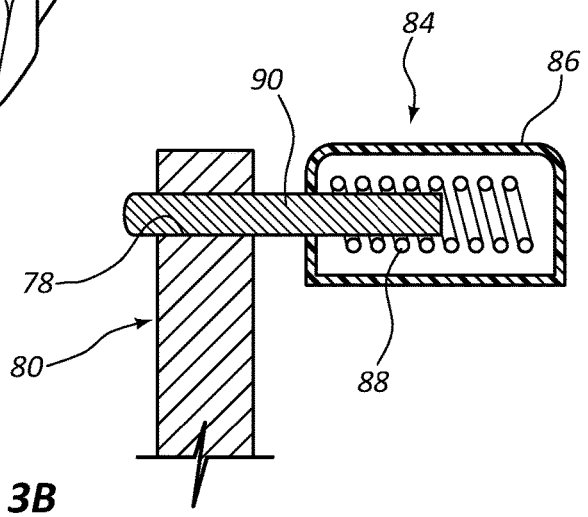
FIG. 3*b* illustrates a cross sectional view of an example of a locking mechanism in accordance with the present disclosure.

The pin 82 may be moved into the holes 78 with any appropriate mechanism. For example, the pin 82 may be part of a solenoid assembly 84 as depicted in FIG. 3*b*. In the example of FIG. 3*b*, the locking mechanism 75 includes a solenoid housing 86, an electrically conductive coil 88, and an enclosed portion 90 of the pin 82. When the electrically conductive coil 88 is electrically energized as a result of a command to secure the position of the first flywheel 18, the electromagnetic forces generated by the electrically conductive coil 88 move the pin 82 towards and into one of the holes 78 formed in the first flywheel 18. As a result, the first flywheel 18 is locked in place, which also locks each of the components of the first mechanical linkage 40, the second mechanical linkage 44, the crank assembly 22, the first foot pedal 34, the second foot pedal 36, the first arm support 38, and the second arm support 42 in position. In some examples where there is an absence of electrical energy being applied to the electrically conductive coil 88 after the pin 82 has been extended, the pin 82 will move back to a retracted position and release the first flywheel 18 from the locking mechanism 75.

Figure 4:
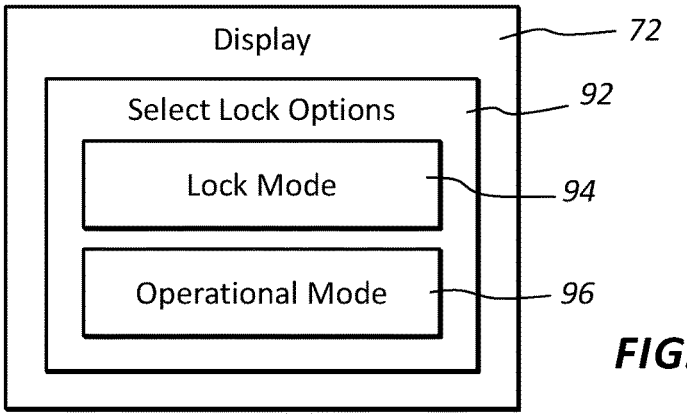
FIG. 4 illustrates a view of an example of a display in accordance with the present disclosure.

FIG. 4 illustrates a view of an example of a display 72 in accordance with the present disclosure. In this example, the display 72 presents to the user lock options 92. The display may be a touch screen display that presents a lock mode button 94 and an operational mode button 96. The locking mechanism 75 will be activated in response to the user selecting the lock mode button 94. Likewise, the locking mechanism 75 will be released so that the user can work out with the elliptical exercise machine 10 in response to the user selecting the operational mode button.

Figure 5:
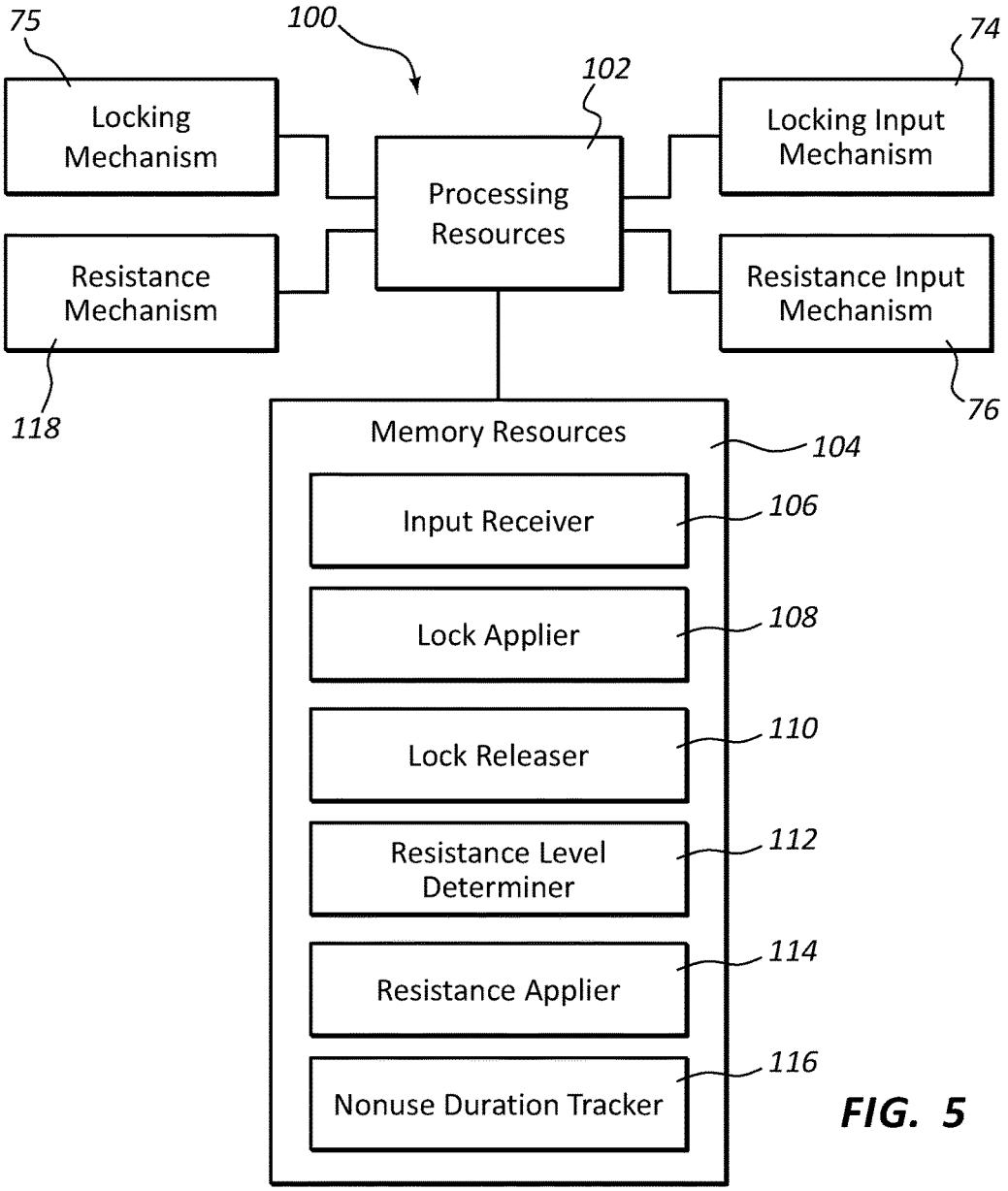
FIG. 5 illustrates a view of an example of a locking system in accordance with the present disclosure.

FIG. 5 illustrates a view of a locking system 100 in accordance with the present disclosure. The locking system 100 may include a combination of hardware and programmed instructions for executing the mechanisms of the locking system 100. In this example, the locking system 100 includes processing resources 102 that are in communication with memory resources 104. Processing resources 102 include at least one processor and other resources used to process programmed instructions. The memory resources 104 represent generally any memory capable of storing data such as programmed instructions or data structures used by the locking system 100. The programmed instructions shown stored in the memory resources 104 include an input receiver 106, a lock applier 108, a lock releaser 110, a resistance level determiner 112, a resistance applier 114, and a non-use duration tracker 116.

The memory resources 104 include a computer readable storage medium that contains computer readable program code to cause tasks to be executed by the processing resources 102. The computer readable storage medium may be tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic storage media, other types of memory, or combinations thereof.

The input receiver 106 represents programmed instructions that, when executed, cause the processing resources 102 to detects when input from locking input mechanism 74 or the resistance input mechanism 76 is received. The lock applier 108 represents programmed instructions that, when executed, cause the processing resources 102 to cause the locking mechanism 75 to activate. The lock applier 108 may activate the lock in response to a command based on user input or sensory input. Likewise, the lock releaser 110 represents programmed instructions that, when executed, cause the processing resources 102 to cause the locking mechanism to release the lock so that the user can move the first foot pedal 34 and the second foot pedal 36.

The resistance level determiner 112 represents programmed instructions that, when executed, cause the processing resources 102 to determine the level of resistance that is currently applied to the resistance mechanism 118. The resistance applier 114 represents programmed instructions that, when executed, cause the processing resources 102 to apply additional resistance or release resistance based on user input through the resistance input mechanism 76.

The non-use duration tracker 116 represents programmed instructions that, when executed, cause the processing resources 102 to determine if the elliptical exercise machine 10 has been unused for a period that exceeds a predetermined time threshold of inactivity. If such a predetermined time threshold has been reached, the lock applier 108 may cause the locking mechanism to secure the first foot pedal 34 and the second foot pedal 36 in place.

Further, the memory resources 104 may be part of an installation package. In response to installing the installation package, the programmed instructions of the memory resources 104 may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the programmed instructions are already installed in the elliptical exercise machine 10. Here, the memory resources 104 can include integrated memory such as a hard drive, a solid state hard drive, or the like.

In some examples, the processing resources 102 and the memory resources 104 are located within the same physical component, such as the elliptical exercise machine 10, a server, or a network component. The memory resources 104 may be part of the physical component's main memory, caches, registers, non-volatile memory, or elsewhere in the physical component's memory hierarchy. Alternatively, the memory resources 104 may be in communication with the processing resources 102 over a network. Further, the data structures, such as the libraries or other repositories, may be accessed from a network location over a network connection while the programmed instructions are located locally.

Figure 6:
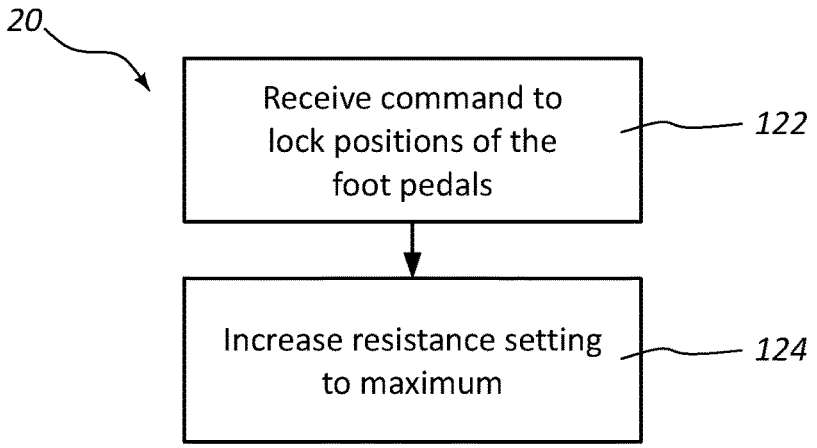
FIG. 6 illustrates an example of an activation method for activating a locking mechanism in accordance with the present disclosure.

FIG. 6 illustrates an example of an activation method 120 for activating a locking mechanism 75 in accordance with the present disclosure. In this example, the activation method 120 includes receiving 122 commands to secure the positions of the first foot pedal 34 and the second foot pedal 36 and increasing 124 the resistance setting of the resistance mechanism 118 to a maximum. In such an example, the locking mechanism 75 is integrated with the resistance mechanism 118. As such, the locking mechanism 75 may use the components of the resistance mechanism 118 to secure the first foot pedal 34 and the second foot pedal 36 in place. In examples where the resistance mechanism 118 includes increasing a magnetic field to resist the movement of a flywheel, the locking mechanism 75 may cause the resistance mechanism 118 to increase its resistance to a maximum level or at least to a level that is sufficient to prevent movement of the flywheel even when a user's entire weight is loaded to either of the first foot pedal 34 or the second foot pedal 36.

Figure 7:
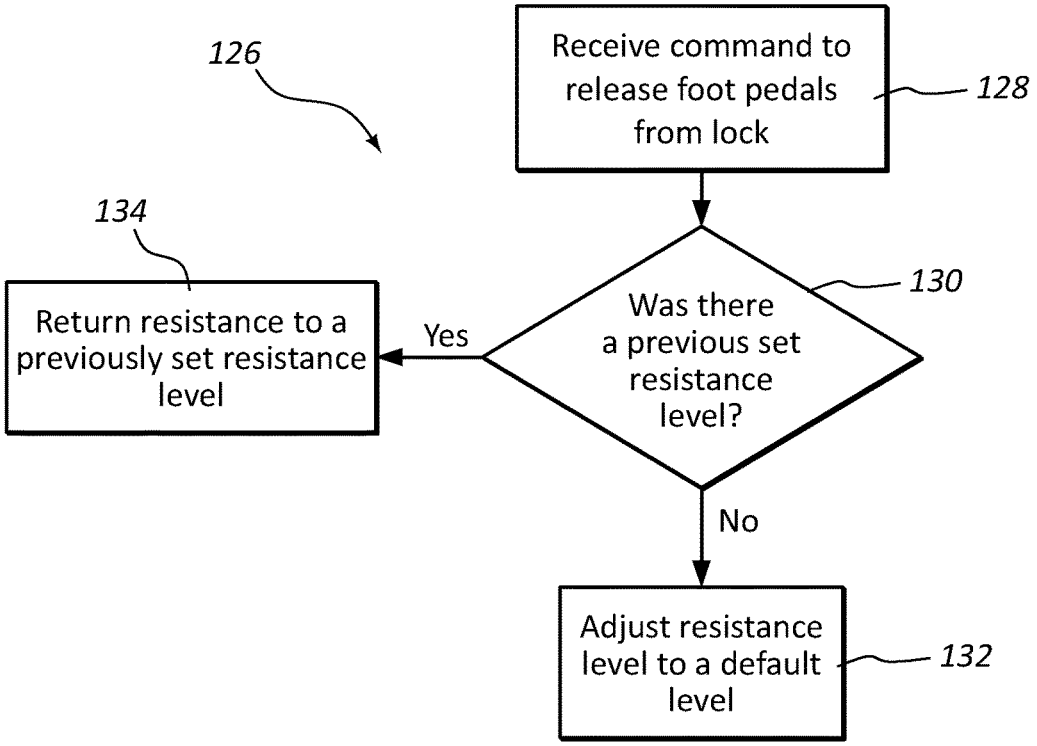
FIG. 7 illustrates an example of a releasing method for releasing a locking mechanism in accordance with the present disclosure.

FIG. 7 illustrates an example of a releasing method 126 for releasing a locking mechanism 75 in accordance with the present disclosure. In this example, the releasing method 126 includes receiving 128 a command to release the foot pedals from the locking mechanism 75 and determining 130 whether there was a pervious set resistance level. If there was no previously set resistance level, then the releasing method 126 includes adjusting 132 the resistance level to a default level. In some examples, the default level may be a zero resistance level. If there was a previously set resistance level, the releasing method 126 includes returning 134 the resistance to the previously set resistance level.

Figure 8:
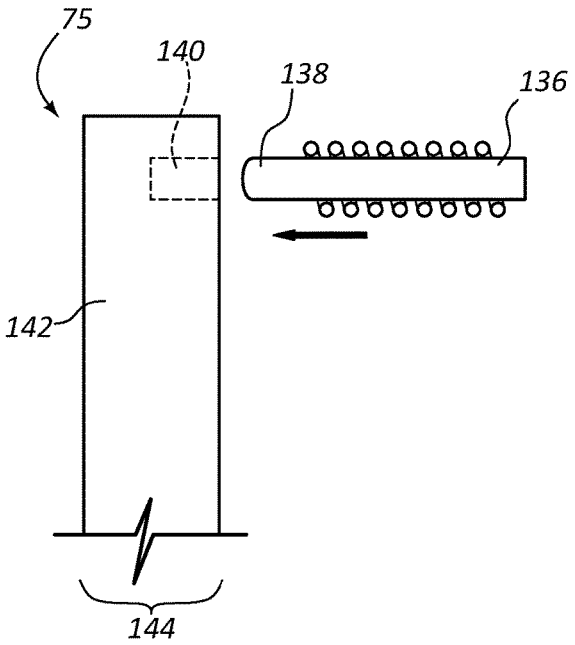
FIG. 8 illustrates a cross sectional view of an alternative example of a locking mechanism in accordance with the present disclosure.

FIG. 8 illustrates a cross sectional view of an alternative example of a locking mechanism 75 in accordance with the present disclosure. In this example, the locking mechanism 75 includes a spring loaded pin 136 that is positioned to have a free end 138 inserted into a recess 140 formed in a flywheel 142. The recess 140 does not extend through the entire thickness 144 of the flywheel 142.

Figure 9:
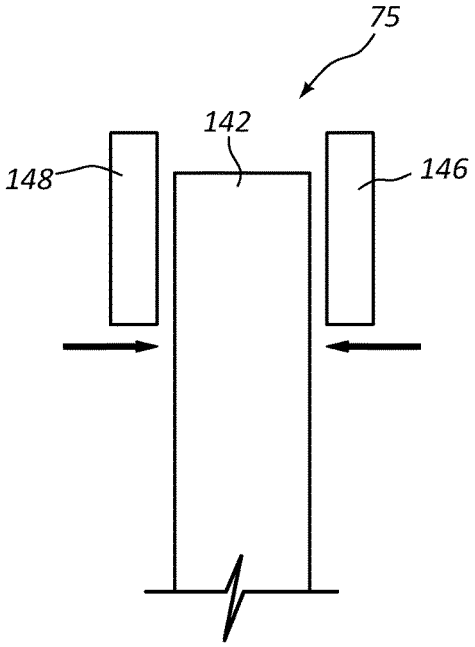
FIG. 9 illustrates a cross sectional view of an alternative example of a locking mechanism in accordance with the present disclosure.

FIG. 9 illustrates a cross sectional view of an alternative example of a locking mechanism 75 in accordance with the present disclosure. In this example, a first pad 146 and a second pad 148 are positioned adjacent to the flywheel 142. In response to an appropriate command, the first pad 146 and/or second pad 148 move toward the flywheel 142 and apply a compressive load to the flywheel 142 that is sufficient to prevent the flywheel's movement. In such an example, the compressive load to the flywheel 142 through the first and second pads 146, 148 may prevent the flywheel 142 from rotating due to friction. In some examples, the pads are felt pads. However, any appropriate material may be used on the pads to create friction and apply the compressive load to the flywheel 142.

In some examples, the outer surface of the flywheel 142 and/or first and second pads 146, 148 may include features that increase the frictional interaction between the two features. For example, the outer surface of the flywheel 142 and/or first and second pads 146, 148 may be knurled. In other examples, the flywheel and/or pads may include coatings, spray coatings, grooves, rough surface finish, or other types of mechanism that increase potential surface finish.

Figure 10:
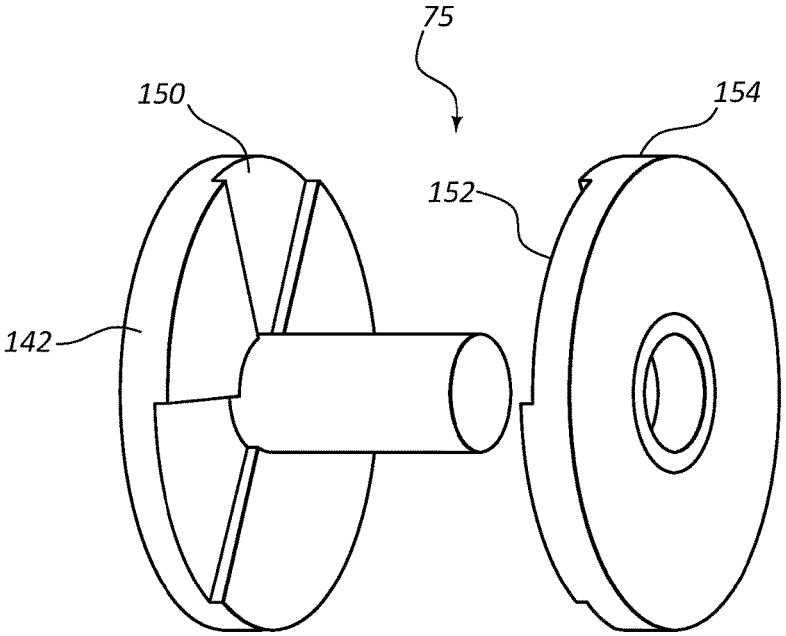
FIG. 10 illustrates a perspective view of an alternative example of a locking mechanism in accordance with the present disclosure.

FIG. 10 illustrates a perspective view of an alternative example of a locking mechanism 75 in accordance with the present disclosure. In this example, the flywheel 142 is shaped with recessed areas 150 that interlock with a face 152 of a movable plate 154 that moves into and interlocks with the flywheel 142 based on a command to secure the foot pedals 34, 36 in place.

Figure 11:
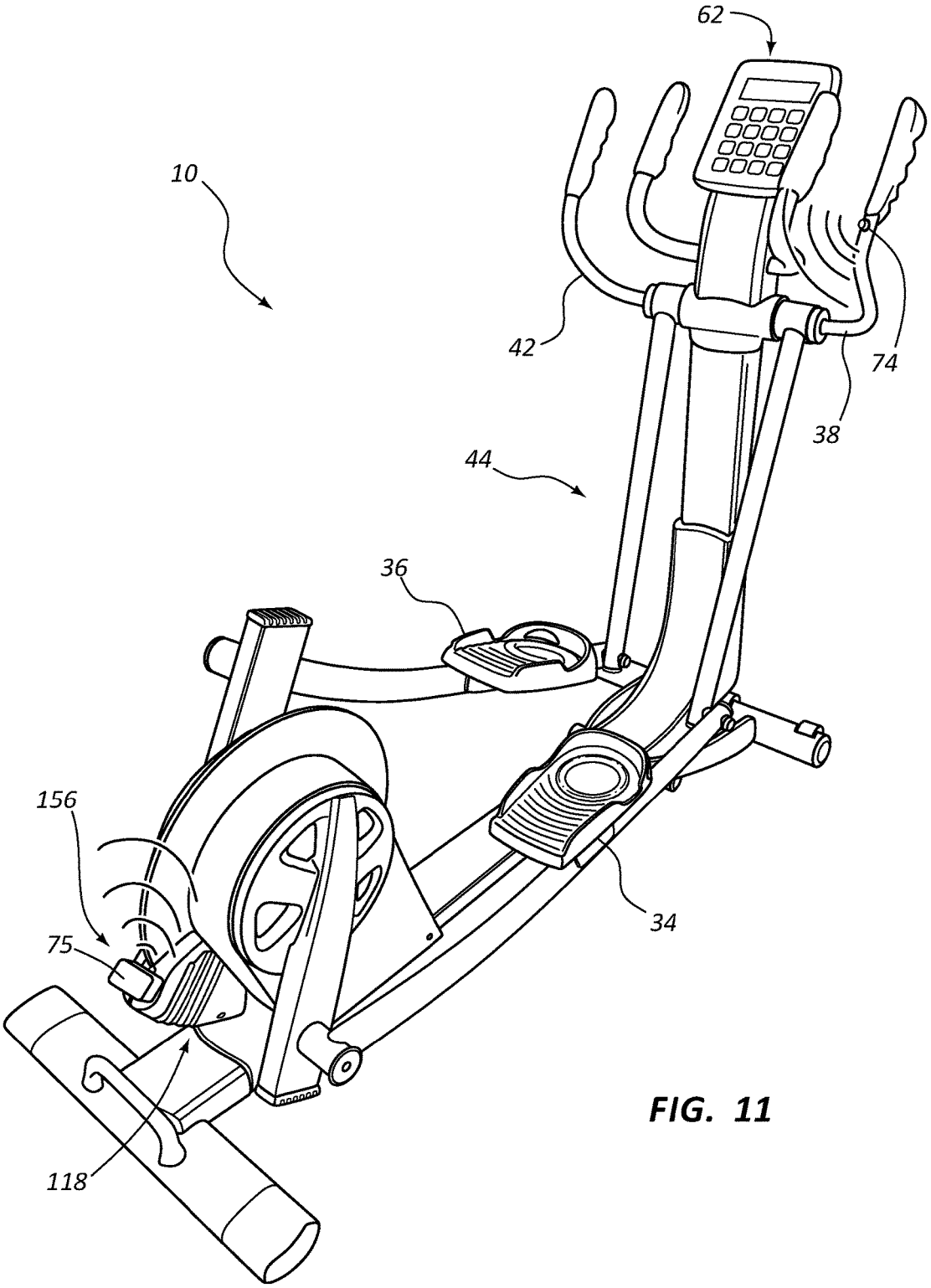
FIG. 11 illustrates a perspective view of an alternative example of a locking mechanism in accordance with the present disclosure.

FIG. 11 illustrates a perspective view of an alternative example of a locking mechanism 75 in accordance with the present disclosure. In this example, the locking input mechanism 74 is in wireless communication with the locking mechanism 75 which is positioned adjacent to the resistance mechanism 118. In this embodiment, the user can control whether the elliptical exercise machine 10 is in a secured mode or an operational mode from a remote location on the first arm support 38. Using a wireless communication interface between the locking input mechanism 74 and the locking mechanism 75 simplifies manufacturing because wires do not have to be routed through or on the moving components of the elliptical exercise machine 10. Both the locking input mechanism 74 and the locking mechanism 75 may be equipped with wireless transceivers 156 that can communicate with each other.

In some examples, the wireless transceivers 156 may communicate with equipment that is not incorporated into the elliptical exercise machine 10. In such examples, the user can operate the locking mechanism 75 with another wireless device, such as a phone, a laptop, an electronic tablet, a network component, another type of wireless device, or combinations thereof. This enables the user to control the locking mechanism 75 from areas that are some distance from the elliptical exercise machine 10, such as in another room, in a different building, or another location.

Further, the wireless transceivers 156 may enable the user to check the status of the locking mechanism 75 from such locations as well.

Figure 12:
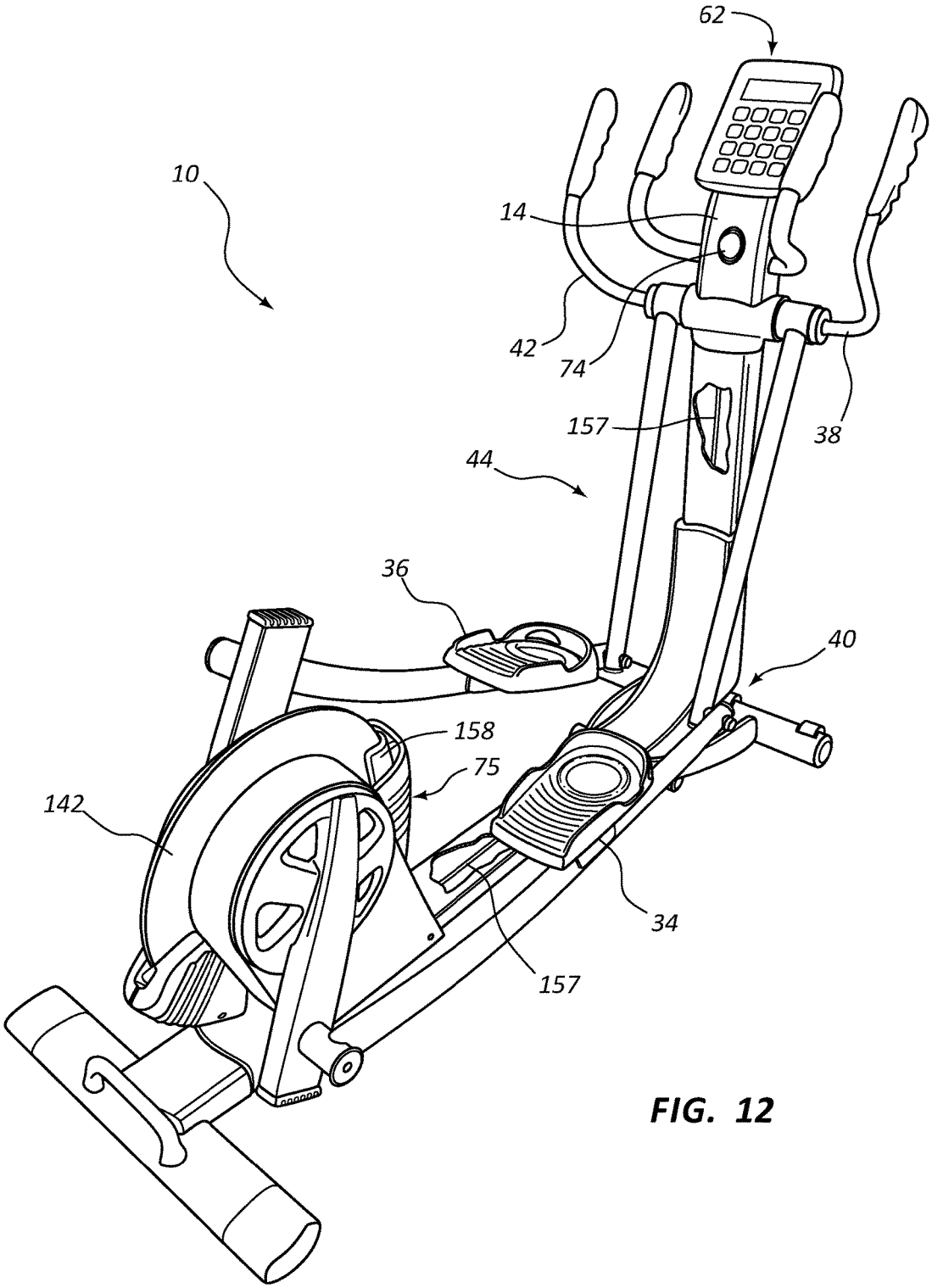
FIG. 12 illustrates a perspective view of an alternative example of a locking mechanism in accordance with the present disclosure.

FIG. 12 illustrates a perspective view of an alternative example of a locking mechanism 75 in accordance with the present disclosure. In this example, the locking input mechanism 74 includes a push button disposed within the support frame 14. A hydraulic or pneumatic line 157 runs from the locking input mechanism 74 to the locking mechanism 75. In the example of FIG. 12, the locking mechanism 75 includes a pair of compression pads 158 that are arranged to move into and put the flywheel 142 into a sufficient amount of compression to prevent the rotation of the flywheel 142 and therefore the movement of the first foot pedal 34 and the second foot pedal 36.

In some examples, the resistance mechanism 76 may operate as a secondary lock. In such an example, if the locking mechanism 75 fails, the resistance mechanism 76 may lock foot pedals 34, 36 in place. In yet other examples, the other types of locking mechanisms may be used as secondary locks to back up a primary locking mechanism. The secondary locks may activate when the primary lock activates, when commanded by a user, or when a primary lock fails.

Figure 13:
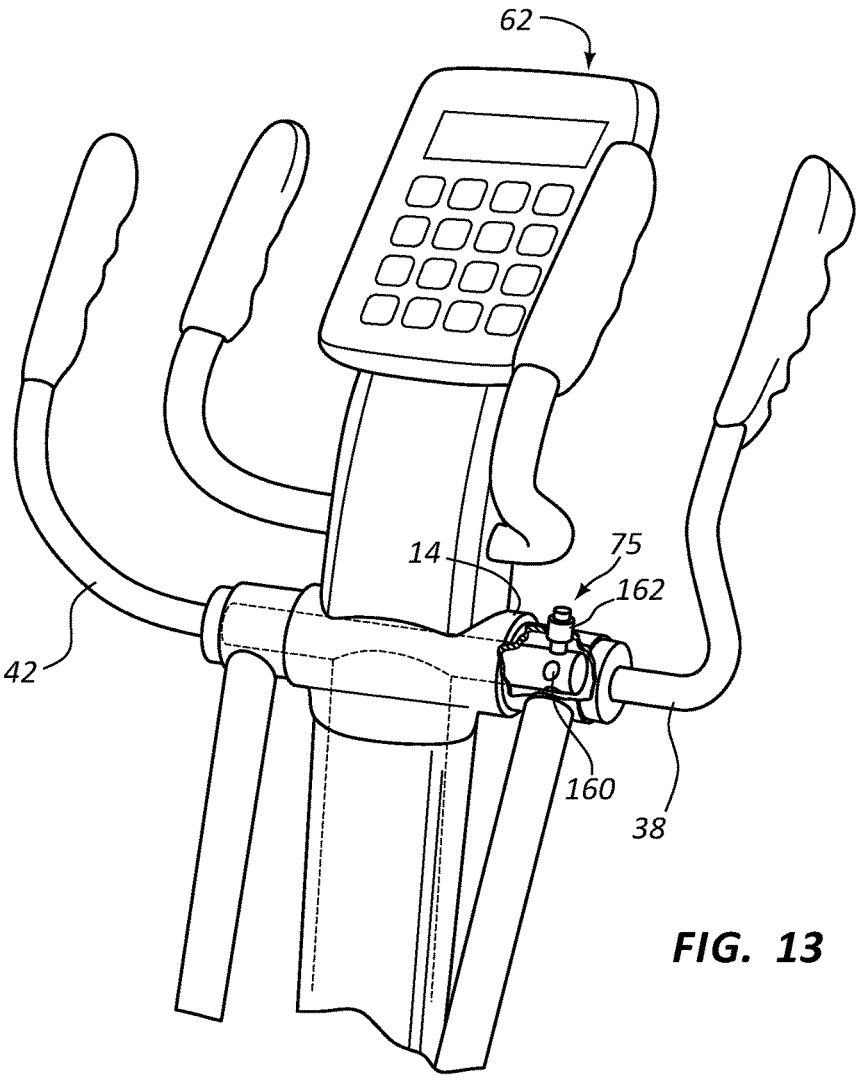
FIG. 13 illustrates a perspective cut away view of an alternative example of a locking mechanism in accordance with the present disclosure.
Figure 14:
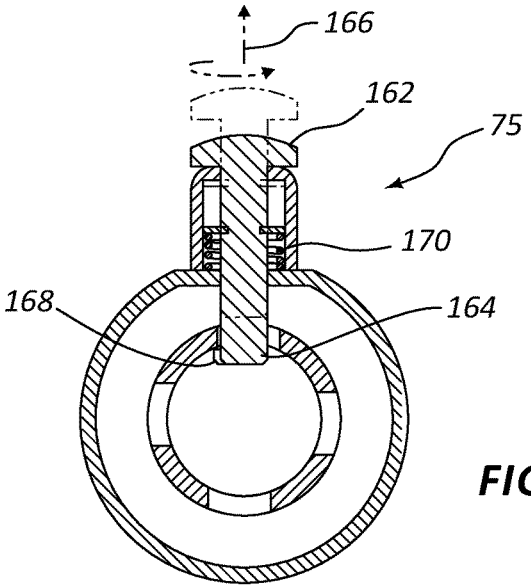
FIG. 14 illustrates a cross sectional view of an alternative example of a locking mechanism in accordance with the present disclosure.

FIG. 13 illustrates a perspective cut away view of an alternative example of a locking mechanism 75 in accordance with the present disclosure. In this example, a portion of the support frame 14 is removed to reveal a slot 160 formed the pivot connection. FIG. 14 illustrates a push rod 162 that can be supported by the cut away portion of the support frame 14. The push rod 162 can be pushed deep enough into the support frame 14 such that a distal end 164 of the push rod moves into the slot 160 and locks the position of the pivot connection with respect to the support frame 14. When the distal end 164 is inserted into the slot 160, the push rod 162 may be rotated about its central axis 166 such that a flange 168 formed in the distal end 164 locks the distal end 164 in the slot 160. The push rod 162 can release the pivot connection by rotating the push rod 162 to the orientation that it entered the slot 160 and either pulling the push rod out 162 of the slot or allowing a spring 170 or another mechanism to move the distal end 164 of the push rod 162 away from the slot 160.

INDUSTRIAL APPLICABILITY

In general, the invention disclosed herein may provide a user with the advantage of positionally locking the foot pedals in place while the user is mounting or dismounting the elliptical exercise machine. While in a secured mode, the foot pedals do not move or shift while the user puts his or her entire weight onto a single foot pedal. As a result, the user is in control of his center of gravity, and the user is more easily able to mount the machine.

The location of the locking input mechanism provides an additional element of convenience because the user can control the locking mechanism, which is often below his knees, while standing on the foot pedals in an upright position. The user does not have to bend down or squat to control the locking mechanism.

The examples described above include embodiments where the foot pedals can be locked in any orientation. Thus, the user does not have to make positional adjustments to get the foot pedals to be locked in place.

Also, some of the above described embodiments include instrumentation that allows the exercise machines to secure and release the position of the foot pedals automatically based on sensed conditions. Such sensed conditions may include, but are not limited to, a duration of inactivity, a weight loaded to a foot pedal, whether a person is mounting or dismounting the exercise machine, whether a child is playing on the exercise machine, other conditions, or combinations thereof. Further, such conditions can be determined based on timers, accelerometers, load cells, distance sensors, cameras, other types of sensors, or combinations thereof.

The principles described in the present disclosure can be applied to multiple types of elliptical exercise machines. For example, these principles can be applied to elliptical exercise machines with multiple flywheels, a single flywheel, foot pedals that travel along paths defined by a crank assembly, foot pedals that travel along paths defined by a linear track, other types of elliptical exercise machines, or combinations thereof. Further, the locking mechanism can lock any appropriate type of component of the elliptical exercise machine that is mechanically linked to the foot pedals such that if the component is locked in place then the foot pedals will also be locked in place.

What is claimed is:

1. An elliptical exercise machine, comprising:

a frame;

a first foot pedal and a second foot pedal movably attached to the frame to travel along reciprocating paths;

a resistance mechanism integrated into the elliptical exercise machine to resist movement of the first foot pedal and the second foot pedal along the reciprocating paths;

a securing mechanism arranged to secure the first foot pedal and the second foot pedal in place and prevent them from moving when the securing mechanism is in a secured mode; and the securing mechanism being in communication with a securing input mechanism located at a remote location from the resistance mechanism;

wherein the resistance mechanism is in communication with a resistance input mechanism;

wherein the securing mechanism is arranged to switch between the secured mode and an operational mode where the first foot pedal and the second foot pedal are released to travel in response to user input received through the securing input mechanism; and wherein the resistance input mechanism is independent of the securing input mechanism, wherein the securing mechanism is integrated into the resistance mechanism such that in response to the user input to be in the secured mode, the resistance mechanism exerts a resistance sufficient to secure the first foot pedal and the second foot pedal in position.

2. The elliptical exercise machine of claim 1, wherein the first foot pedal is mechanically linked to a first arm support and the second foot pedal is mechanically linked to a second arm support wherein the first arm support and the second arm support move in a reciprocating motion as the first foot pedal and the second foot pedal travel along the reciprocating paths.

3. The elliptical exercise machine of claim 1, wherein the securing mechanism is arranged to exert a magnetic resistance sufficient to secure the first foot pedal and the second foot pedal in position.

4. The elliptical exercise machine of claim 1, wherein the securing mechanism includes a feature arranged to move into and secure a mechanical linkage mechanically connected the first foot pedal and the second foot pedal.

5. The elliptical exercise machine of claim 1, wherein the securing mechanism includes a feature arranged to move into and interlock with a flywheel.

6. The elliptical exercise machine of claim 1, wherein a default mode of the securing mechanism is the secured mode.

7. The elliptical exercise machine of claim 1, wherein the securing input mechanism is a button.

8. The elliptical exercise machine of claim 1, wherein the securing mechanism includes a storage memory medium and a processor wherein the storage memory medium comprises programmed instructions that, when executed by the processor, control when the securing mechanism is in the secured mode or in the operational mode.

9. The elliptical exercise machine of claim 8, wherein the programmed instructions, when executed by the processor, cause the securing mechanism to switch to the secured mode in response to a predetermined period of non-use.

10. The elliptical exercise machine of claim 1, wherein the elliptical exercise machine comprises a second securing mechanism arranged to prevent the first foot pedal and the second foot pedal from traveling.

11. The elliptical exercise machine of claim 1, wherein the securing input mechanism is located proximate a console, near the console, on the console, in an arm guard, on a handgrip, on an upper portion of the frame of the elliptical exercise machine, or combinations thereof.

12. An elliptical exercise machine, comprising:

a frame;

a first foot pedal and a second foot pedal attached to the frame to travel along reciprocating paths;

a resistance mechanism integrated into the elliptical exercise machine to resist movement of the first foot pedal and the second foot pedal along the reciprocating paths;

a locking mechanism arranged to prevent the first foot pedal and the second foot pedal from moving when the locking mechanism is in a secured mode;

the locking mechanism being in communication with a locking input mechanism integrated into the elliptical exercise machine at a remote location from the resistance mechanism; and the locking mechanism includes a storage memory medium and a processor wherein the storage memory medium comprises programmed instructions that, when executed by the processor, switch the locking mechanism between the secured mode and an operational mode where the first foot pedal and the second foot pedal are released to travel in response to user input received through the locking input mechanism, wherein the locking mechanism is integrated into the resistance mechanism such that in response to the user input to be in the secured mode, the resistance mechanism exerts a resistance sufficient to scure the first foot pedal and the second foot pedal position.

13. The elliptical exercise machine of claim 12, wherein the resistance mechanism is in communication with a resistance input mechanism in communication with the resistance mechanism to apply an amount of resistance to the travel of the first foot pedal and the second foot pedal where the resistance input mechanism is independent of the locking input mechanism.

14. The elliptical exercise machine of claim 12, wherein the programmed instructions further cause the locking mechanism to switch to the secured mode in response to a predetermined period of non-use.

15. The elliptical exercise machine of claim 12, wherein the locking input mechanism located proximate a console is located near the console, on the console, in an arm guard, on handgrips, on an upper portion of the frame of the elliptical exercise machine, or combinations thereof.

16. The elliptical exercise machine of claim 12, wherein a default mode of the locking mechanism is the secured mode.

17. An elliptical exercise machine, comprising:

a frame;

a first foot pedal and a second foot pedal attached to the frame to travel along reciprocating paths;

a resistance mechanism integrated into the elliptical exercise machine to resist movement of the first foot pedal and the second foot pedal along the reciprocating paths;

a locking mechanism arranged to prevent the first foot pedal and the second foot pedal from moving when the locking mechanism is in a secured mode;

the locking mechanism being in communication with a locking input mechanism integrated into the elliptical exercise machine and located in a control module arranged to control mechanisms of the elliptical exercise machine;

the locking mechanism includes a storage memory medium and a processor wherein the storage memory medium comprises programmed instructions that, when executed by the processor, switch the locking mechanism between the secured mode and an operational mode where the first foot pedal and the second foot pedal are released to travel in response to user input received through the locking input mechanism;

the programmed instructions further cause the locking mechanism to switch to the secured mode in response to a predetermined period of non-use; and the locking mechanism is integrated into the resistance mechanism such that in response to the user input to be in the secured mode, the resistance mechanism exerts a resistance sufficient to secure the first foot pedal and the second foot pedal in position.

* * * * *